US005531388A

United States Patent [19]

Brundiek et al.

[11] Patent Number: 5,531,388

[45] Date of Patent: Jul. 2, 1996

[54] AIR-SWEPT MILL

[75] Inventors: Horst Brundiek, Kaarst; Willy Lohle, Neuss, both of Germany

[73] Assignee: Loesche GmbH, Dusseldorf, Germany

[21] Appl. No.: 230,946

[22] Filed: Apr. 21, 1994

[30] Foreign Application Priority Data

Jul. 14, 1993 [DE] Germany ..... 43 23 587.5

[51] Int. Cl.[6] ..... B02C 23/12

[52] U.S. Cl. ..... 241/48; 241/57; 241/80; 241/117

[58] Field of Search ..... 241/48, 52, 53, 241/57, 58, 60, 61, 79.1, 80, 82, 110, 117–121; 209/138, 139.1, 139.2

[56] References Cited

U.S. PATENT DOCUMENTS

| | | | |
|---|---|---|---|
| 3,510,071 | 5/1970 | Whitney, Jr. | 241/82 X |
| 3,677,478 | 7/1972 | Schutte | 241/82 |
| 4,084,754 | 4/1978 | Brundich | 241/119 X |
| 4,550,879 | 11/1985 | Tanaka et al. . | |
| 4,919,341 | 4/1990 | Lohnherr | 241/57 X |
| 5,251,831 | 10/1993 | Yoshida et al. | 241/117 X |

FOREIGN PATENT DOCUMENTS

| | | | |
|---|---|---|---|
| 0112022 | 8/1983 | European Pat. Off. . | |
| 1152297 | 7/1956 | Germany . | |
| 2505379C2 | 2/1975 | Germany . | |
| 141791 | 11/1977 | Germany . | |
| 3202054A1 | 1/1982 | Germany . | |
| 8425837 U | 8/1984 | Germany . | |
| 3515444 | 10/1986 | Germany | 241/57 |
| 3801229A1 | 1/1988 | Germany . | |
| 3834965A1 | 10/1988 | Germany . | |
| 4124416A1 | 7/1991 | Germany . | |

*Primary Examiner*—Timothy V. Eley
*Attorney, Agent, or Firm*—Keck, Mahin & Cate

[57] ABSTRACT

An air-swept mill has an annular space with a blade ring between a rotary grinding pan and a casing wall for fluid delivery flow. The annular space and the blade ring form a gas directing or guiding device for rotary flow and circulation flow of the fluid delivery flow. Above the grinding pan, in the vicinity of a classifier, the casing wall is provided with at least one removal device for removing a part of an outer oversize flow, which is formed as a vented concentrated flow substantially directly at the casing wall.

14 Claims, 3 Drawing Sheets

AIR-SWEPT MILL

BACKGROUND OF THE INVENTION (a) Field of Invention

The invention relates to a method for crushing material of different grain size, in which the material is supplied to a rotating, horizontally positioned grinding surface of a grinding-classifying chamber having a casing wall and is crushed to grinding material particles, in which the grinding material particles are supplied with the aid of a delivery flow introduced on the circumference of the grinding surface to a classifying process and fine material particles are discharged and in which a part of the oversize occurring as coarse material particles is removed, as well as to an apparatus for performing the method especially an air-swept mill having between a rotating grinding pan and a casing wall an annular space with a blade ring for a fluid delivery flow.

(b) State of Prior Art

It is known to relieve a grinding-classifying chamber, e.g. an air-swept roller mill, of the non-crushed or not adequately crushed grinding material, the so-called oversize, in that said oversize is drawn off to the outside during the grinding process and is then generally returned to said process.

Through the removal of a specific percentage of oversize material, the flow resistance in the grinding-classifying chamber drops, so that it is possible to reduce the delivery energy for a fluid flow to be expended on a unit. The necessary mechanical energy for a mechanical oversize return located outside the grinding-classifying chamber is much smaller.

DE 41 24 416 A1 discloses such a method. Oversize material, which has been rejected by the classifier as tailings, on a dropping path to a grinding surface are at least partly removed to the outside via a screw conveyor.

According to a method known from DE-AS 1 152 297 in an air-swept roller mill with integrated classifier a fluid, e.g. air or a gas is introduced into a grinding-classifying chamber. The fluid is brought in an annular space between the grinding pan and the casing wall to such a high speed that substantially all the grinding material particles spun off from the grinding pan under the action of centrifugal force, i.e. from the charge particle size to the finished particle size, are taken up by the fluid flow and conveyed to the classifier as a two-phase mixture.

By means of a fluid flow at a relatively low speed it is ensured that a high percentage of largely non-crushed material drops downwards out of the mill. In this way the pneumatic conveying energy of the fluid flow unit can be lowered as a result of a reduced flow resistance due to a lower grinding material load.

In the known methods grinding material particles are drawn from the grinding, classifying, drying and pneumatic conveying process occurring the mill and the classifier, so that there is a change to one of the numerous factors influencing a complex dynamic grinding-classifying system.

It is known that the modification of one factor, e.g. the modification to the speed of the delivery flow in the annular clearance of the removal of grinding material particles from the grinding-classifying process, influences further parameters, such as e.g. the wall friction, gas friction, friction between the gas and grinding material particles, flow formation in the mill and classifier, particle distribution and particle sizes, so that there must be a new state of equilibrium.

Even a partial removal of uncrushed or inadequately crushed grinding material particles has a negative influence on the grinding bed formation on the grinding pan, because coarse particles in conjunction with fine particles lead to a maximum packing density and to an almost ideally compacted and optimum crushable grinding bed. However, if coarse particles, e.g. up to 250%, based on the finished material flow, is removed from the grinding material flow enriched with particles and circulating in the grinding-classifying chamber, the coarse particles are more particularly missing from the grinding bed formation. This leads to the disadvantage of there being no autogenous grinding aid on the part of the coarse particles. Since during the external delivery process no crushing occurs, neither the coarse nor the particles undergo further crushing.

Although a reduction of the flow energy leads to a saving of pneumatic delivery energy at the fan, this procedure leads to a reduced crushing capacity, so that all things considered there is no saving with respect to the overall, specific power requirement.

SUMMARY OF THE INVENTION

The object of the invention is to provide a method and an apparatus for crushing material, which leads to a reduced energy consumption per ground ton of crushing material and permits an increased throughput of the crushing apparatus or plant.

According to the invention this object is achieved by a method for crushing material of different grain size, in which the material is supplied to a rotating, horizontally positioned grinding surface of a grinding-classifying chamber having a casing wall and is crushed to grinding material particles, in which the grinding material particles are supplied with the aid of a delivery flow introduced on the circumference of the grinding surface to a classifying process and fine material particles are discharged and in which a part of the oversize occurring as coarse material particles is removed, wherein grinding material particles spun over the edge of the grinding surface are exposed to a rotary delivery flow, the spun off grinding material particles are moved upwards in a helical flow, close to the casing wall a particle flow is formed as an almost vented concentrated flow and the vented concentrated flow is at least partly removed from the grinding-classifying chamber and an apparatus for crushing material for performing the method, especially an air-swept mill, which between a rotary grinding pan and a casing wall has an annular space with a blade ring for a fluid delivery flow, the annular space and the blade ring forming a gas directing or guiding device for a rotary and circulation flow of the fluid delivery flow and above the grinding pan in the vicinity of the casing wall is provided at least one removal device for removing of a part of the oversize from an outer oversize flow.

According to the invention, the grinding material particles spun by centrifugal force from a rotary, horizontally positioned, e.g. almost planar, inclined or also through-shaped grinding surface in a grinding-classifying chamber are exposed to a rotary flow of a fluid delivery flow introduced on the circumference of the grinding surface. The grinding material particles, which are conveyed in a helical upward movement, form, as a result of a clearly defined delivery flow speed and the rotary or twisting flow of a gas directing device for guiding the gas an almost vented concentrated or compacted flow, which is at least partly removed from the grinding-classifying chamber and is preferably returned by means of an external delivery device to the grinding chamber.

The basic idea of the invention is to form an almost fines-free, external oversize flow substantially directly at the casing wall in the form of a vented concentrated flow and to at least partly remove its dead material or mass.

Thus, the method according to the invention also provides for the saving of pneumatic delivery energy by oversize removal from the grinding-classifying chamber in order to reduce the flow resistance. Unlike in the case of the known methods, removal only takes place of the oversize, which as dead material or mass burden the grinding-classifying chamber, because they do not continuously participate in the grinding and classifying process.

It is in particular provided to produce the almost fines-free, vented concentrated flow called the external oversize flow, by a clearly oriented delivery flow with a speed of >30 m/s, particularly with an twist producing gas directing device, e.g. through an angular setting of a blade ring in the tangential direction. The rotary flow or flow twist leads to a helical upward movement of the fluid flow with the grinding material particles spun from the grinding pan. A twisting flow produces centrifugal forces due to the internal expansion tendency and they also act on the grinding material particles. As a function of their size, said particles are also subject to a dragging force of the fluid flow produced in the direction of the classifier, i.e. towards the centre of the grinding-classifying chamber. The equilibrium conditions which occur are dependent on the mass of the grinding material particles. Independently of the action of a classifier, which is arranged in integrated manner in or mounted on top of an air-swept mill, due to a blade ring classifying of the outwardly spun grinding material particles, a grain separation is brought about solely by the use of a specifically constructed and arranged gas directing device for guiding the gas and a vented concentrated flow is formed.

It is advantageous that in the case of an adequate enrichment or accumulation of grinding material particles in the vented concentrated flow as a result of gravity action on said particles to bring about a downward movement directly at the casing wall, so that a so-called particle torus of limited radial extension is formed. The outer oversize flow or the particle torus rotates about its vertical axis which is parallel or coaxial to the grinding-classifying chamber axis. It is important that the outer oversize flow or particle torus is inwardly thickened to a specific, radial extension and without participating in the grinding and classifying process is kept suspended by an outer downward flow and an inner upward flow in the grinding-classifying chamber.

It is appropriate to at least partly remove from the marginal zone area oversize fractions of the outer oversize flow, said removal taking place continuously and under air exclusion.

It is particularly appropriate to return the removed oversize fractions following external mechanical conveying in bypass round the air-swept mill and classifier, the supply taking place together with a fresh material charge or separately therefrom.

According to the method of the invention oversize fractions of the outer oversize flow of 200±50%, based on the finished product rate of the mill, or any percentage below this can be removed, without impairing the effectiveness of the crushing process and the classification. A continuous removal of the outer oversize material not participating in the grinding and classifying process leads to a continuous relief of the grinding-classifying chamber and to a reduction of approximately 30% of the flow energy to be expended. The disadvantage occurring in the hitherto known methods, that an adequately crushed grinding material particle fraction is also removed from the grinding process does not occur here.

An apparatus for crushing material with especially an airswept mill, particularly for performing the method, provides a gas directing device formed by a per se known blade ring in an annular space around a rotary grinding pan for forming a rotary and circulation flow of the fluid delivery flow and at least one removal device in the vicinity of the casing wall of the air-swept mill for an oversize fraction of an outer oversize flow or the vented concentrated flow.

A preferred removal device is a pocket connected tangentially in the mill and/or classifier casing, in which collect the oversize rotating on the wall under centrifugal force and gravity action and which can be automatically vented by dynamic pressure action. Appropriately the pocket is provided with an outlet connection issuing an air lock.

In order to be able to remove oversize fractions from the outer oversize flow with a given thickness and virtually peel off the same, it is appropriate to have an almost slot-like removal area with an adjustable opening. For example, it is possible to remove an oversize fraction with the aid of a guide plate pivotably located on the casing wall. It is also possible to have a vertically or horizontally displaceable plate, which permits an increase or decrease in the size of the removal area.

From the pocket the removed oversize faction can be supplied in the vented, compressed state, particularly by gravity, to a mechanical conveying device, e.g. a bucket elevator. This mechanical conveying device can be connected to a further crushing device. Preferably the mechanical conveying device is connected for the purpose of returning the removed oversize fractions to a charging device for the charge or directly to the grinding-classifying chamber or the grinding pan for an almost central supply.

In an development of the apparatus according to the invention the mechanical conveying device is supplied at least partly with the inner oversize separated from the classifier and/or the grinding material particles dropping downwards over the grinding pan and to return the same to a further crushing process, particularly the air-swept roller mill grinding pan.

The gas directing device for guiding the gas is constructed in such a way that a fluid flow entering the air-swept mill below the grinding pan is forced into a rotary or twisting flow, so that the grinding material particles spun off said pan are conveyed upwards in a helical path and directly to the casing wall.

Appropriately the blades of a blade ring positioned at an angle and in the tangential direction form flow channels through which a fluid flow at a speed of >30 m/s exerts an ejector action, so that the outer oversize flow or concentrated flow rotating close the casing wall is produced.

BRIEF DESCRIPTION OF THE DRAWINGS

The invention is described in greater detail hereinafter relative to the drawings, wherein show.

DETAILED DESCRIPTION OF THE INVENTION

Figure 1:
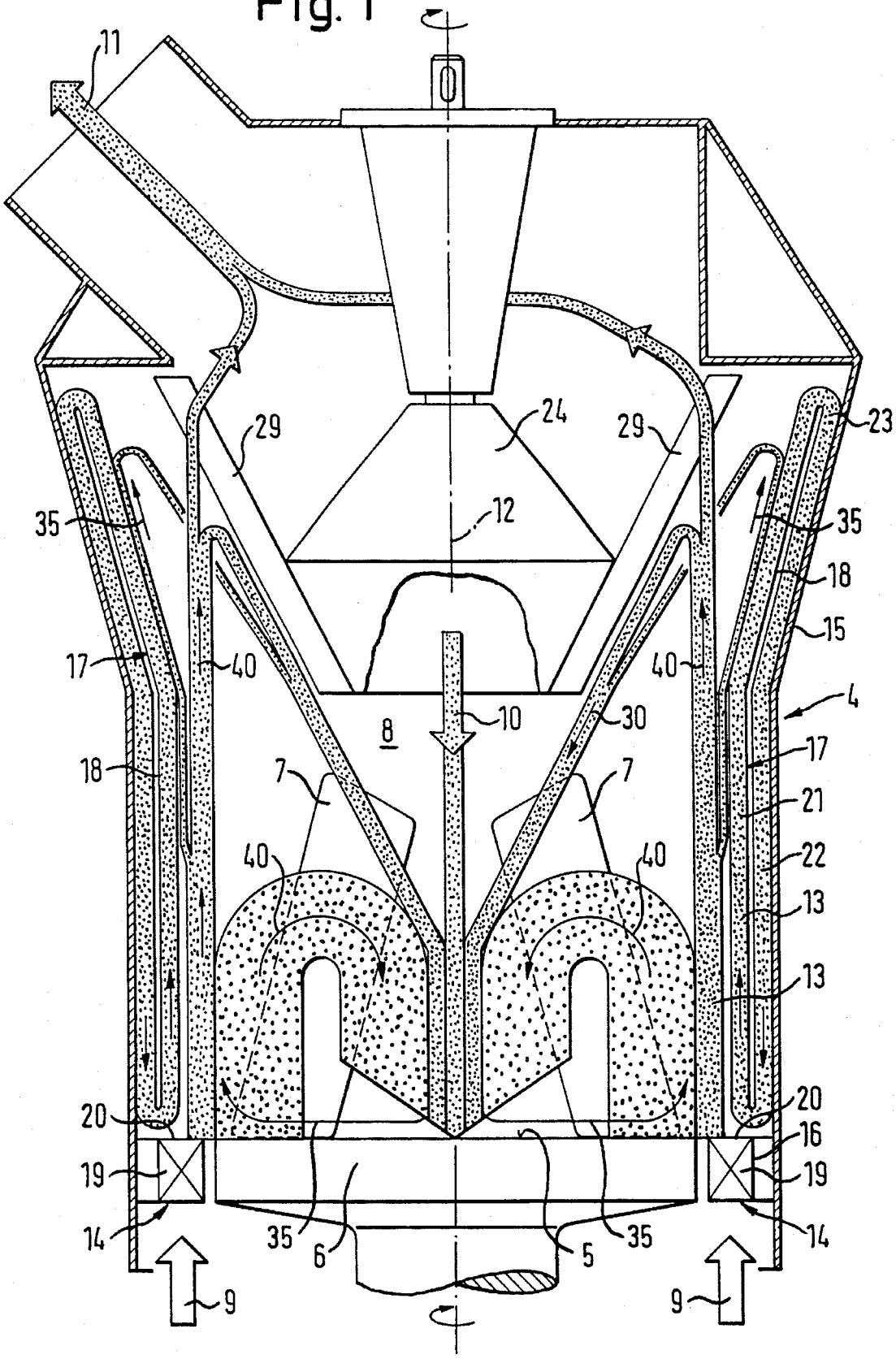
FIG. 1 A diagrammatic representation of an air-swept mill with the essential flow conditions.

FIG. 1 shows an air-swept mill 4 with a grinding pan 6, on whose grinding surface 5 are separately driven or roll by frictional resistance grinding rolls 7. Above the grinding rolls 7 and in an integrated arrangement within a grinding-classifying chamber 8 bounded by a casing wall 15 is provided a classifier 29 with a classifier rotor 24.

The material of different grain size to be crushed is supplied almost centrally to the grinding surface 5 as a charge 10 by means of a not shown supply mechanism. Between the casing wall 15 and the grinding pan 6 is formed an annular space 14, in which a blade ring 16 of blades arranged and constructed in a clearly defined manner forms an annular gas directing device 19, whose flow channels 20 give a delivery flow 9 of a fluid, particularly a gas, an ejector action. As a result of an angular setting of the blade ring 16 in the tangential direction a rotary and circulation flow 21, 22 is produced in the immediate vicinity of the casing wall 15, in which the grinding material particles 13 are taken up in a virtually vented concentrated flow 17.

The vented concentrated flow 17 is formed by a blade ring classification of the crushed grinding material particles 13 spun from the grinding surface 5 to the annular gas directing device 19. As a result of the helical upward movement of the flow twist produced in the gas directing device 19, the vented concentrated flow 17 is not deflected towards the classifier 29. Following an enrichment with grinding material particles 13 gravity comes into action and together with an ejector action on each flow channel 20 a circulation flow 21, 22 is formed about a virtually vertical axis, which is characterized by an internal upward flow 21 and an external downward flow 22. This overall flow extending in the wall area of the air-swept mill 4 is of limited radial extension and constitutes a particle torus.

The particle torus can be looked upon as a dead mass 23, which thickens to a specific radial extension and is then kept suspended only in a flow area without participating in the grinding and classifying.

The particle torus, an outer oversize flow 18 circulating about a vertical axis, starting from the ejector action of the flow channels 20, sucks in both fluid and grinding material particles in accordance with the arrow 35. These fractions come from a circulation (arrows 40) within the grinding-classification chamber 8. As a result of the lower partial pressure a higher proportion flows from above through the centre of the air-swept mill and with the crushed Grinding material flow over the Grinding surface 5 to the edge of the Grinding pan 6. A relatively small proportion is sucked in between the upward flow 40 and the casing wall 15.

The outer oversize flow 18 or the particle torus, which as a result of the construction of the Gas directing respectively Guiding device 19 rotates helically about the axis 12 of the air-swept mill 4, is subject to a relatively stable twist flow which attempts to expand. The centrifugal force of the vertical or twist flow is utilized for removing oversize fractions from the outer oversize flow 18.

Figure 2:
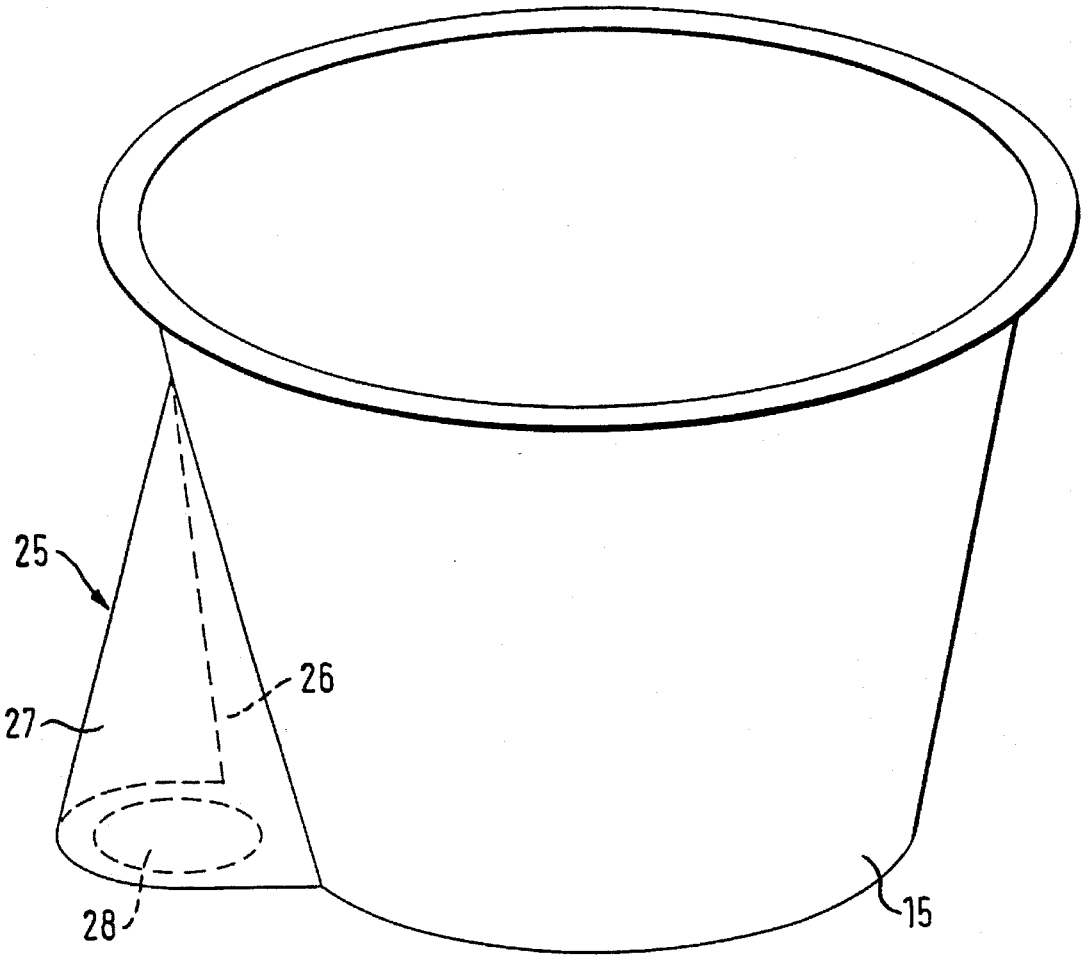
FIG. 2 A highly diagrammatic, perspective view of a removal device for an outer oversize flow formed on a mill casing.
Figure 3:
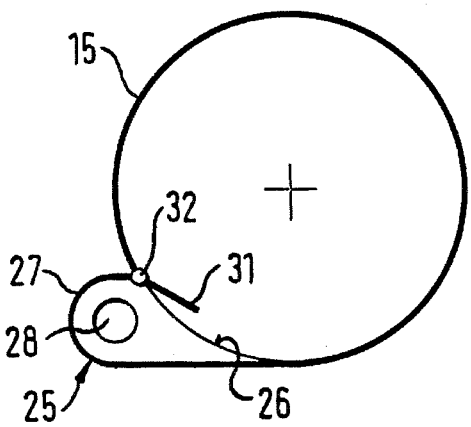
FIG. 3 A cross-section through an air-swept mill in the vicinity of the removal device.

FIGS. 2 and 3 are a highly diagrammatic representation of an arrangement and construction of a removal device 25 in the upper area of the casing wall 15. The removal device 25 is constructed as a pocket 27, positioned tangentially on the casing wall 15 on a level with the classifier 29. The pocket 27 has a slot-like removal area 26 and a bottom discharge opening 28 located at right angles to the removal area. In said pocket 27 collects the oversize material of the outer oversize flow 18 rotating under centrifugal force and Gravity action on the casing wall 15 and are automatically vented by dynamic pressure action. The almost slot-like removal area 26 of the removal device 25, in order to permit a regulated removal of the oversize fractions, is provided with an adjustable Guide plate 31, which is articulated by means of a vertical pivot pin 32 to the casing wall 15. As a function of the opening angle of the Guide plate 31 a larger or smaller, shell-like fraction of the outer oversize flow 18 can be removed. The discharge opening 28 can be constructed as an adjustable opening in the same way as the removal area 26.

Figure 4:
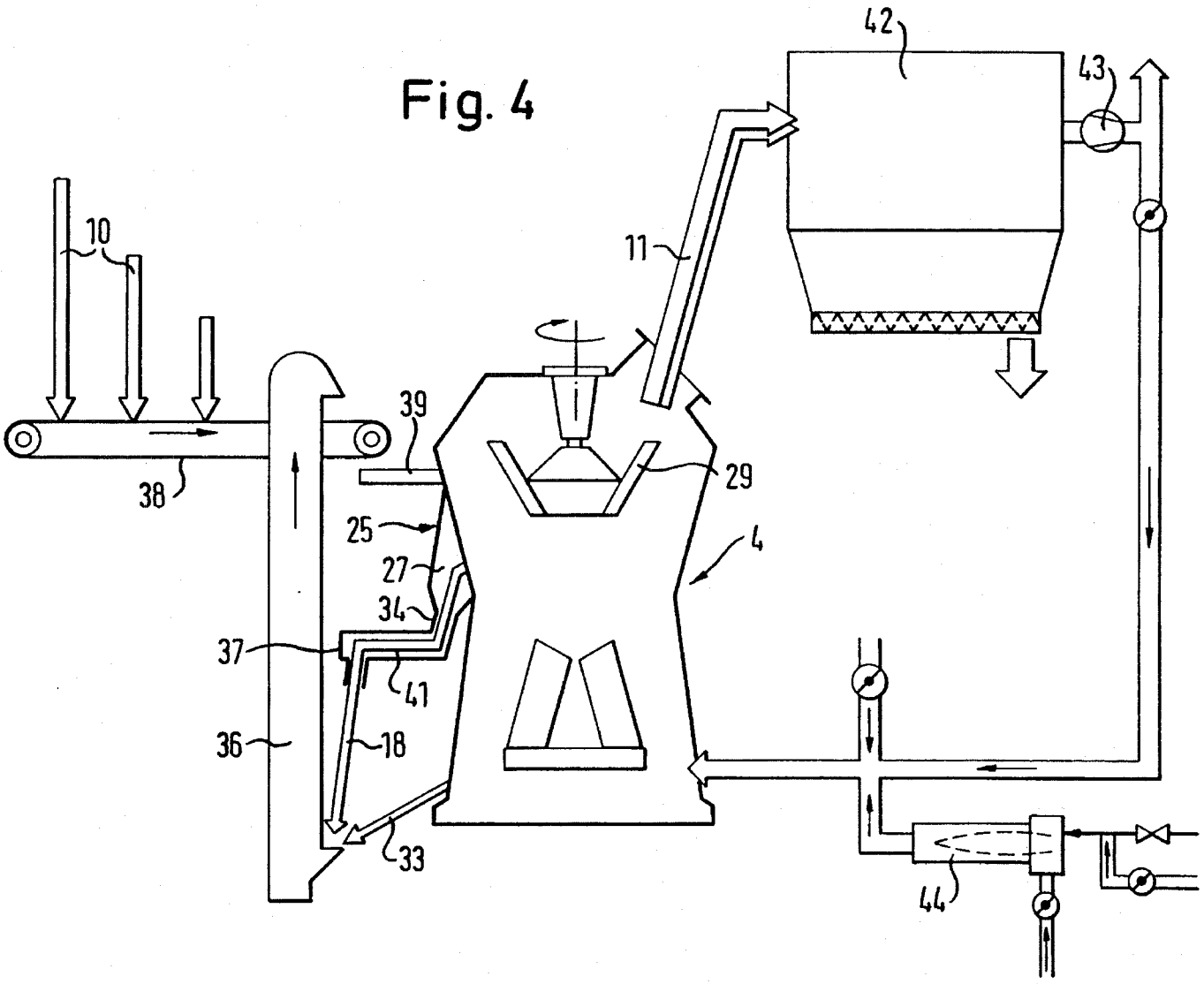
FIG. 4 A diagrammatic representation of the method with the essential equipment.

FIG. 4 is an equipment diagram with the essential units for performing the method according to the invention. The material of different grain size to be crushed, e.g. in the form of a three-component mixture, is supplied to a charging device 38 and by means of an inlet connection 39 to the air-swept mill 4. Together with the charge 10 are supplied oversize fractions of the outer oversize flow 18 from a pocket 27 in the form of the removal device 25 and with the aid of a mechanical conveying device 36, e.g. a bucket elevator. Together with the oversize fraction of the outer oversize flow 18, grinding material particles 33 and in particular oversize material which has dropped downwards over the annular gas directing device 19 (FIG. 1), are passed to the mechanical conveying device 36 and charged in bypass manner to the air-swept mill 4. Most of the crushed grinding material particles undergo classification with the aid of the integrated classifier 29. The fine material particles pass in the fluid flow via a fines outlet 11 into a filter 42, where the fluid and in particular a process gas is separated from the fines and by means of a fan 43 and optionally by a furnace 44 is preheated to a clearly defined temperature returned to the air-swept mill 4.

The tangentially positioned removal device 25 is provided with an outlet connection 34, optionally a dosing-discharge conveyor 41 and an air lock 37.

What we claim is:

1. An air-swept mill apparatus comprising, between a rotary grinding pan and a casing wall, an annular space with a blade ring for fluid delivery flow, for crushing material of different grain size, in which the material is supplied to a rotating, horizontally positioned grinding surface of a grinding-classifying chamber having a casing wall and is crushed to grinding material particles, in which the grinding material particles are supplied with the aid of a delivery flow introduced on a circumference of the grinding surface to a classifying process, and fine material particles are discharged and in which a portion of oversize material occurring as coarse material particles, is removed, wherein grinding material particles spun over an edge of the grinding surface are exposed to a rotary flow of the delivery flow, spun off grinding material particles are moved upwards in a helical flow, close to the casing wall a particle flow is formed as an almost vented concentrated flow and the vented concentrated flow is at least partly removed from the grinding-classifying chamber, wherein the annular space and the blade ring form a gas directing device for guiding gas for rotary flow and circulation flow of the fluid delivery flow and above the grinding pan in the casing wall there is at least one removal device for receiving an oversize fraction from an outer oversize flow.

2. In an apparatus according to claim 1, wherein the gas directing device has flow channels with an ejector effect and the removal device is constructed as a pocket arranged tangentially on the casing wall.

3. In an apparatus according to claim 2, characterized in that the pocket is located in the casing wall of a classifier and in the vicinity of a dead mass of the outer oversize flow which is not subject to a grinding and classifying process.

4. In an apparatus according to claim 2, characterized in that the tangentially arranged pocket has a substantially slot-shaped removal area and a bottom discharge opening.

5. In an apparatus according to claim 4, wherein the removal area is adapted for adjustable removal of the oversize fraction.

6. In an apparatus according to claim 5, wherein the removal area comprises an adjustable guide plate.

7. In an apparatus according to claim 6, wherein the guide plate is located on the casing wall and is pivotable about a vertical axis.

8. In an apparatus according to claim 4, wherein the discharge opening is adapted for adjustable removal of the oversize fraction.

9. In an apparatus according to claim 2, wherein the pocket is provided with an outlet connection and with an air lock.

10. In an apparatus according to claim 1, wherein the removal device is connected to a mechanical conveying device for returning the oversize fraction of the outer oversize flow to the grinding pan.

11. In an apparatus according to claim 10, wherein the mechanical conveying device is connected to a charging device.

12. In an apparatus according to claim 10, characterized in that the mechanical conveying device is adapted for receiving internal oversize material.

13. In an apparatus according to claim 10, wherein grinding material particles dropping downwards over the grinding pan can be supplied to the mechanical conveying device.

14. In an apparatus according to claim 1, wherein flow channels with an ejector effect are formed by an angular setting of a blade ring in the tangential direction.

* * * * *